United States Patent [19]

Spethmann

[11] 4,109,704

[45] Aug. 29, 1978

[54] HEATING AND COOLING COST MINIMIZATION

[75] Inventor: Donald H. Spethmann, Arlington Hts., Ill.

[73] Assignee: Honeywell Inc., Minneapolis, Minn.

[21] Appl. No.: 781,898

[22] Filed: Mar. 28, 1977

[51] Int. Cl.[2] ..... F25B 29/00; F24F 3/10

[52] U.S. Cl. ..... 165/16; 165/22; 165/31; 236/1 C

[58] Field of Search ..... 165/16, 22, 31; 236/1 C, 49

[56] References Cited

U.S. PATENT DOCUMENTS

| | | | |
|---|---|---|---|
| 2,209,787 | 7/1940 | Miller | 165/16 |
| 3,179,338 | 4/1965 | Ostrander | 165/16 X |
| 3,927,713 | 12/1975 | Gilles | 165/16 |
| 3,949,809 | 4/1976 | Gilles | 165/22 |
| 4,042,013 | 8/1977 | Demaray et al. | 165/16 X |
| 4,044,823 | 8/1977 | Biesecker | 165/16 |
| 4,044,947 | 8/1977 | Spethman | 165/16 X |

*Primary Examiner*—Carlton R. Croyle
*Assistant Examiner*—Leonard E. Smith
*Attorney, Agent, or Firm*—Trevor B. Joike

[57] ABSTRACT

In an air conditioning system having both a hot deck for heating air and a cold deck for cooling air, both decks being supplied by a supply duct, a control system is disclosed for minimizing the total cost of heating the air in the hot deck and cooling the air in the cold deck by measuring the amount of heating done in the hot deck and deriving the heating cost therefrom, measuring the amount of cooling done in the cold deck and deriving the cooling cost therefrom, and controlling the temperature of the air in the supply duct until the heating cost equals the cooling cost to thereby minimize the total heating and cooling costs.

21 Claims, 6 Drawing Figures

HEATING AND COOLING COST MINIMIZATION

BACKGROUND OF THE INVENTION

This invention relates to air conditioning systems which include both a hot deck for supplying heated air and a cold deck for supplying cooled air to a plurality of zones and, more particularly, to minimizing the heating and cooling costs in such a system.

A typical commercial building consists of a plurality of offices or rooms which, in the air conditioning industry, are called zones. Commercial buildings usually have two types of zones, exterior zones which are those located around the perimeter of the building and are affected by solar radiation, outdoor temperature and wind, and interior zones which, because they have no walls or windows exposed to the outdoors, are not affected by solar radiation, outdoor temperatures and wind.

Because the exterior zones are affected by solar radiation, wind and outdoor temperature conditions, the heating and cooling of such exterior zones are affected by seasonal changes. Specifically, during the winter months the exterior zones are heated and during the summer months the exterior zones are cooled. Interior zones are not affected by seasonal changes and are usually cooling loads during both winter and summer. The air conditioning system in such a building must, therefore, be capable of supplying both cooling air and heating air.

One common system for the supply of air conditioned air to such buildings is the double duct system having a hot deck for supplying heated air and a cold deck for supplying cooled air to the zones. Such air conditioning systems are controlled in a variety of ways. For example, both the hot deck and the cold deck may be connected to each zone and the air from each deck may be mixed in a ratio to maintain the temperature of that zone at the desired setting. The temperature of the air issuing from the cold deck is controlled at a point to satisfy the zone needing the most cooling, and the air from the cold deck is then mixed with the air from the hot deck in ratios to satisfy the cooling needs of the other cooling zones. Likewise, the temperature of the air issuing from the hot deck is controlled at a point to satisfy the zone needing the most heat and the air issuing from the hot deck is mixed with the air issuing from the cold deck in ratios to satisfy the other heating zones. Energy is conserved in this manner because the temperature of the hot deck is not hotter than is sufficient to meet the needs of the zone requiring the most heating and the temperature of the cold deck is not colder than is sufficient to meet the needs of the zone requiring the most cooling.

Both the hot deck and the cold deck are supplied with air from a supply duct which derives its air from, typically, a return air duct which returns air from the zones of the building to the air conditioning system and an outdoor duct which draws fresh air from the outside into the building. The return air duct and the outdoor air duct each have respective dampers for controlling the mixture of outdoor and return air supplied to the hot and cold decks. The supply duct may also have a cooling coil therein for cooling and dehumidifying the mixture of return air and outdoor air. To the extent possible, the outdoor and return air dampers and the cooling coil in the supply duct are controlled such that a minimum amount of cooling is done in the cold deck to satisfy the zone having the greatest cooling load. Thus, the mixed air is treated as a free source of cooling and ideally the temperature of this mixed air is controlled at a point which will require no further cooling in the cold deck. The fallacy of this approach is that heating can cost much more than cooling and the use of free cooling, therefore, can be very expensive in terms of heating costs. The present invention discards the free cooling approach and instead controls the temperature of the mixed air at a point which will minimize the total heating and cooling costs of the air conditioning system.

SUMMARY OF THE INVENTION

To minimize this total cost, the amount of heating done in the hot deck is measured and a heating cost is derived therefrom, the amount of cooling done in the cold deck is measured and a cooling cost is derived therefrom, the heating cost and the cooling cost are compared and used to control the temperature of the air in the supply duct at a point which will equalize the heating cost and the cooling cost. Thus, the combined heating and cooling costs are minimized.

BRIEF DESCRIPTION OF THE DRAWINGS

These and other features and advantages will become apparent from a detailed review of the drawings in which.

DETAILED DESCRIPTION OF THE DRAWINGS

Figure 1:
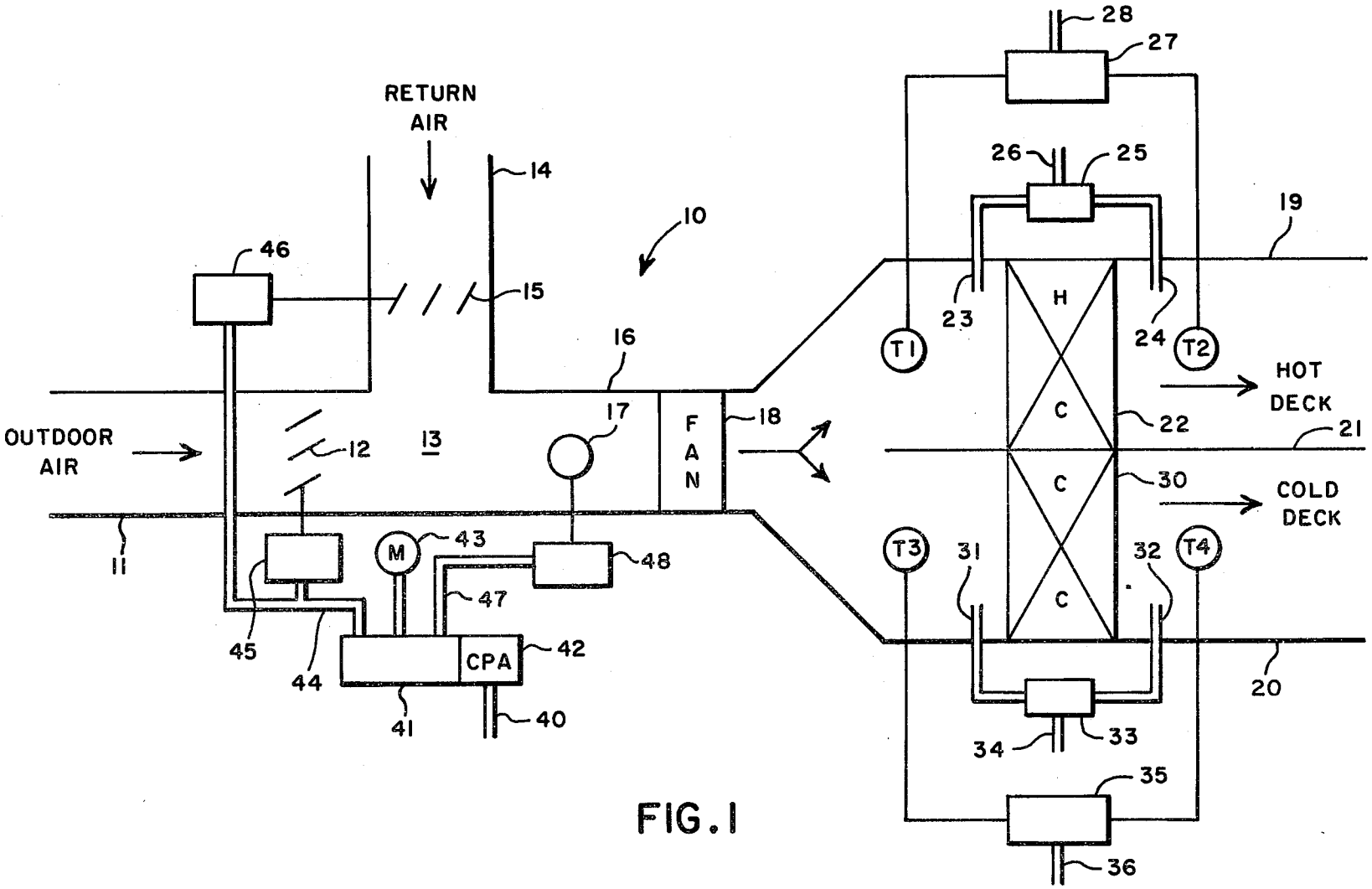
FIG. 1 is a diagram showing a double duct air conditioning system.

In FIG. 1, outdoor air duct 11 of air conditioning system 10 supplies outdoor air through outdoor air damper 12 to mixing chamber 13. Return air duct 14 supplies return air from the zones supplied by the air conditioning system through return air damper 15 to mixing chamber 13. The mixture of outdoor air and return air is supplied to supply duct 16 having temperature sensor 17 and fan 18 located therein. The air in supply duct 16 is driven by fan 18 to hot deck 19 and cold deck 20 having partition 21 for separating the hot deck and the cold deck. In hot deck 19 is located heating coil 22 for heating the air supplied from supply duct 16 and supplied to the zones to which hot deck 19 is connected. In order to measure the amount of heating done in hot deck 19, pressure sensor 23 is located upstream of heating coil 22 and pressure sensor 24 is located downstream. These two pressure sensors, 23 and 24, are connected to circuit 25 which provides at its output 26 a signal indicative of the volume of air moving through hot deck 19. In addition, temperature sensor T1 is located upstream and temperature sensor T2 is located downstream of heating coil 22. These temperature sensors may be L7033 sensors manufactured by Honeywell Inc. and supply an electrical output proportional to the temperature of the air being sensed. Temperature sensors T1 and T2 are connected to circuit 27 which provides at its output 28 a pneumatic signal proportional to the difference between the temperatures measured by sensors T1 and T2.

Likewise, cooling coil 30 is located in cold duct 20 for cooling the air supplied by cold deck 20 to the zones. In order to measure the amount of cooling done in cold deck 20, pressure sensor 31 is located upstream of cooling coil 30 and pressure sensor 31 is located downstream. These two pressure sensors, 31 and 32, are connected to circuit 33 which supplies at its output 34 a signal indicative of the volume of air moving through the cold deck. Also, temperature sensor T2 is located upstream of cooling coil 30 and temperature sensor T4 is located downstream. As in the case of temperature sensors T1 and T2, sensors T3 and T4 may be L7033 sensors manufactured by Honeywell Inc. These sensors are connected to circuit 35 which provides a pneumatic signal at output 36 proportional to the difference of the temperatures measured by sensors T3 and T4. It is to be noted that temperature sensors T1 and T3 may be the same temperature sensor since both of these sensors measure the same quantity, i.e., the temperature of the air supplied by supply duct 16. It must also be noted that temperature sensors T1–T4 may be enthalpy sensors in which case the change in enthalpy across heating coil 22 and cooling coil 30 are measured to ultimately control the enthalpy of the mixed air; thus, measuring heating and cooling includes either temperature measurement or enthalpy measurement.

Figure 2:
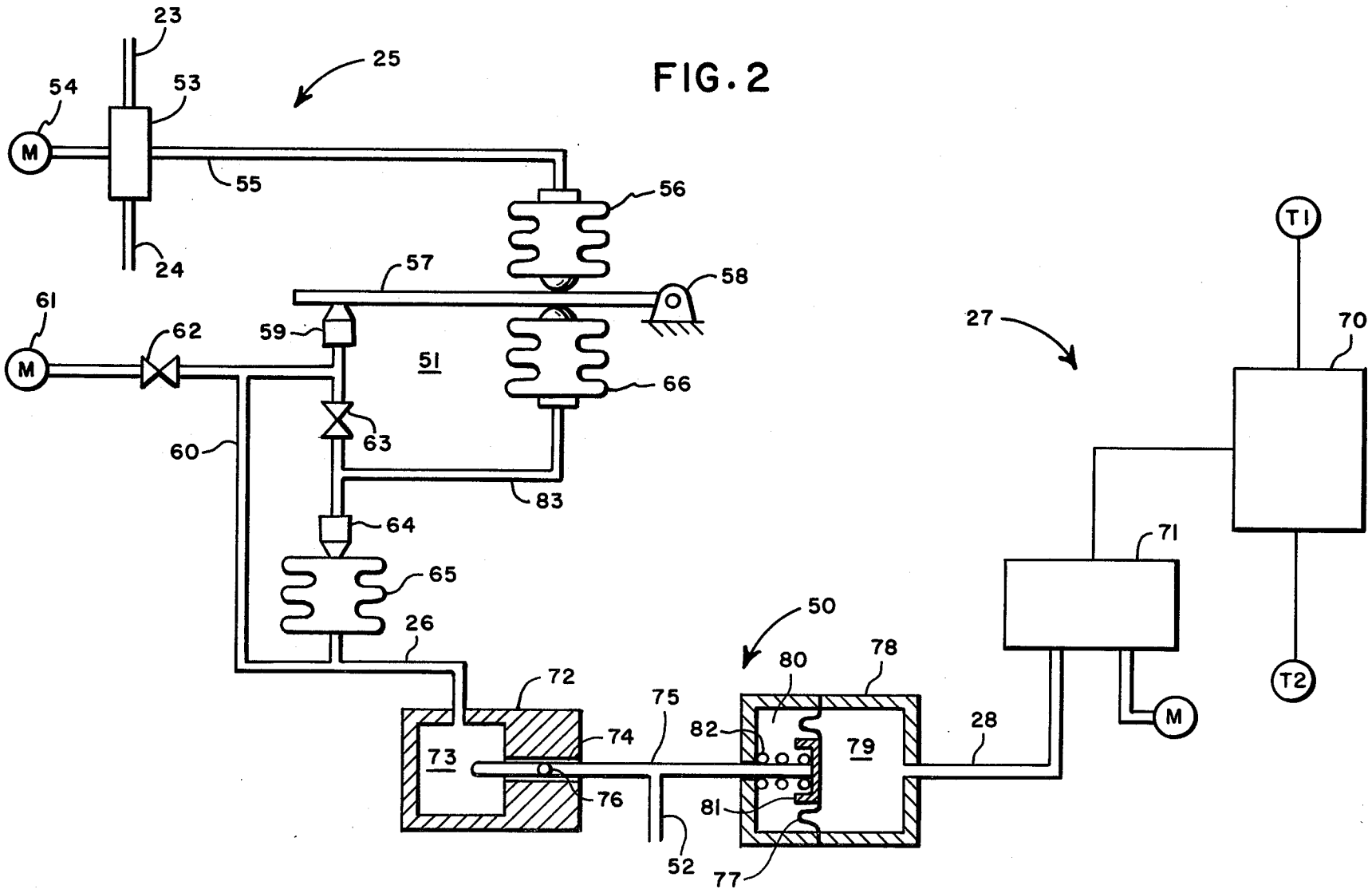
FIG. 2 is a schematic diagram of a system for measuring the amount of heating done in the hot deck of the system of FIG. 1.
Figure 3:
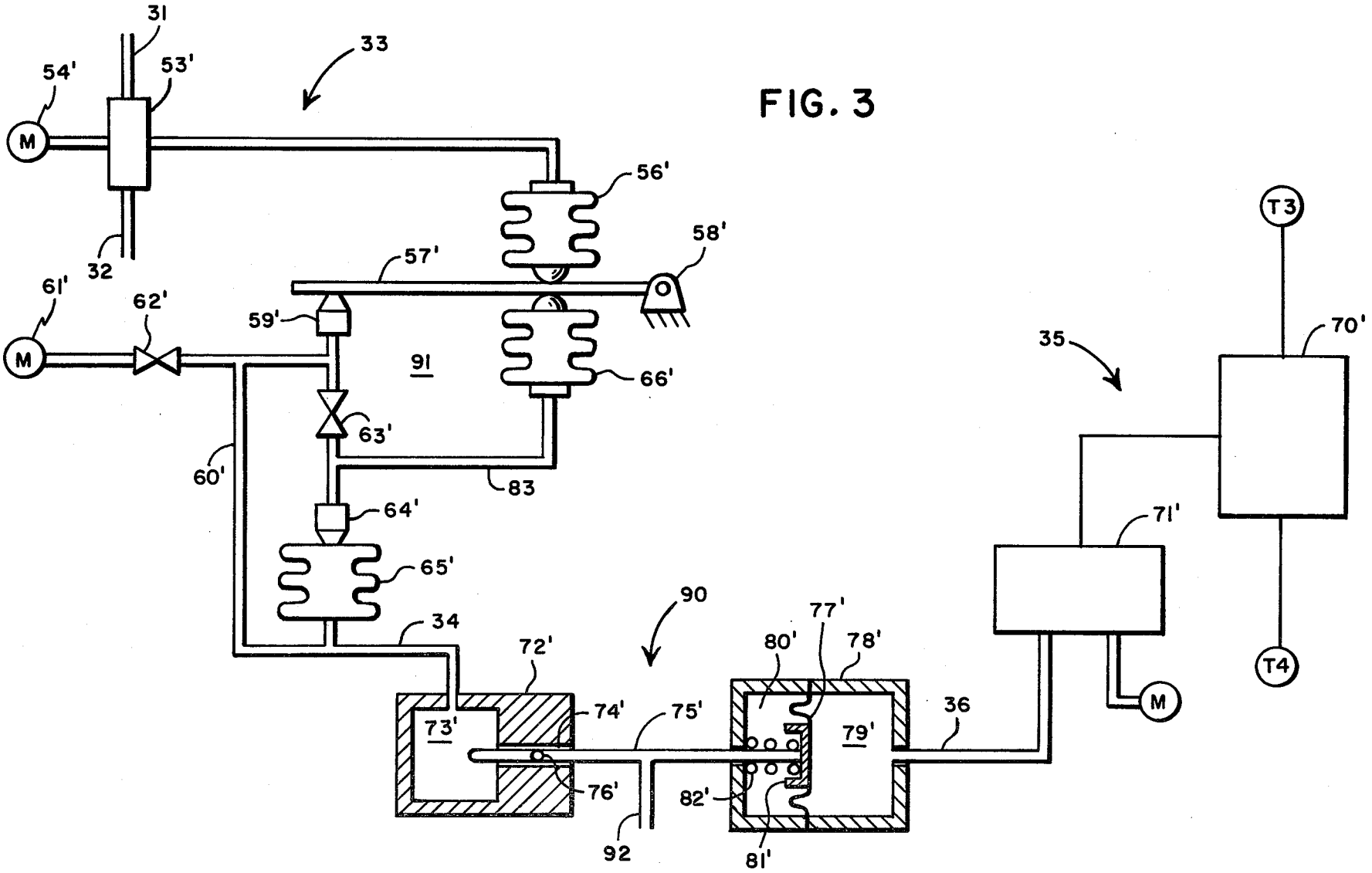
FIG. 3 is a schematic diagram of a system for measuring the amount of cooling done in the cold deck of the system of FIG. 1.
Figure 4:
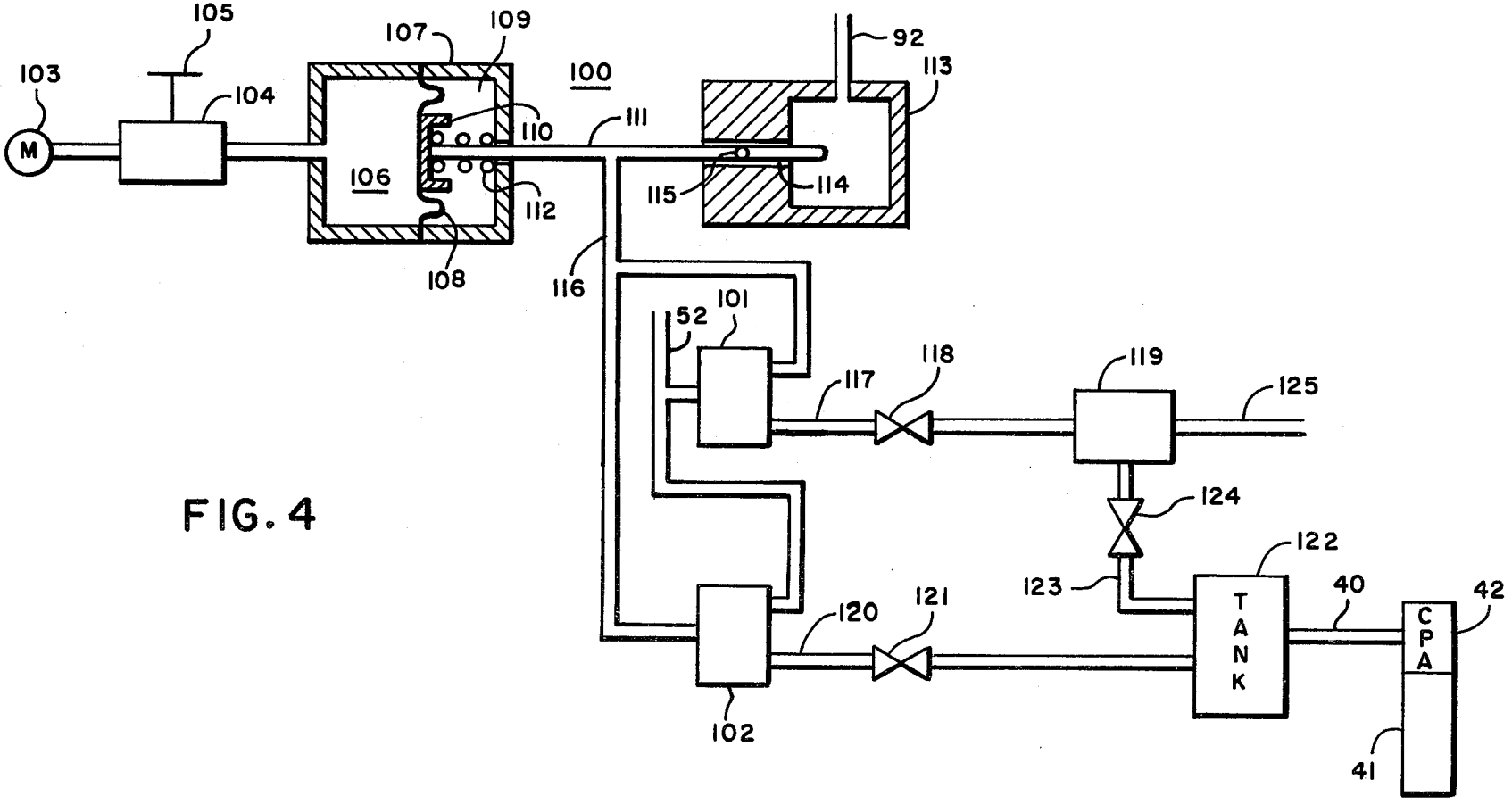
FIG. 4 is a schematic diagram of a system for comparing the amount of heating done to the amount of cooling done as adjusted by the relative heating and cooling costs to control the temperature of the air in the supply duct.

The outputs 26, 28, 34 and 36 are used to supply the control circuits of FIGS. 2 and 3 and these in conjunction with the circuit of FIG. 4 supply input 40 of the control point adjustment 42 of controller 41. Controller 41 may be an RP908A relay manufactured by Honeywell Inc. configured such that an increasing control point adjustment input 40 results in an increasing control point and a decreasing output 44 to close damper 12 and open damper 15 and a decreasing control point adjustment input 40 results in a decreasing control point and an increasing output 44 to open damper 12 and close damper 15. This controller serves to provide proportional control in air conditioning systems. It has a control point adjustment portion 42, which is connected to input 40 and has an input connected to main pressure 43 and has an input 47 supplied by sensor 48. Sensor 48 converts the electrical signal from stat 17 to a pneumatic signal. Output 44 of this controller is connected to damper actuating motors 45 and 46. Motor 45 controls the position of damper 12 and motor 46 controls the position of damper 15. As the output in line 44 changes, damper 12 will be driven in one direction and damper 15 will be driven in the opposite direction. Thus, the temperature in the mixing chamber 13 can be controlled by adjusting the ratio of return air to outdoor air as controlled by dampers 15 and 12.

The system to determine the amount of heating done in hot deck 19 is shown in FIG. 2. This system comprises control circuit 25 which produces the signal at output 26 indicative of the volume of air moving through hot deck 19, circuit 27 which produces a pneumatic signal at 28 proportional to the difference between the temperatures sensed by T1 and T2, and variable gain attenuator 50 which has an input connected to line 26 and a gain changing input connected to line 28. The variable gain attenuator 50 produces an output at 52 which indicates the amount of heating done in hot deck 19.

Circuit 25 comprises a pressure regulator 53 which has a first input connected to pressure sensor 23 and a second input connected to pressure sensor 24. Pressure regulator 53 is also connected to a source of main pressure 54. Pressure regulator 53 may be a PP904 manufactured by Honeywell Inc. This pressure regulator produces an output at line 55 which is proportional to the difference between the pressures sensed by sensors 23 and 24. The output at line 55 is thus the pressure differential across heating coil 22 in hot deck 19. It can be shown that volume is a function of the square of this differential pressure. Therefore, to derive volume, the square root of the output in line 55 must be taken. Circuit 51 is a square root extracting circuit. Output 55 is supplied to a first bellows 56 which acts against lever 57 pivoted at point 58. Lever 57 operates in conjunction with nozzle 59 to control the pressure in line 60. The junction of line 60 and nozzle 59 is connected to a source of main pressure 61 through restriction 62. This junction is also connected through restriction 63 to nozzle 164 which operates in conjunction with bellows 65 having an input connected to the output line 26. The junction of restriction 63 and nozzle 64 is connected to a second bellows 66 arranged to apply a force to lever 57 opposite to the force applied by bellows 56. Nozzle 64, since it is supplied through restriction 63 by line 60, and bellows 65, since it is supplied by line 60 and 26, form a squaring device which squares the output in line 83 and applies this squared output as a feedback to bellows 66. Because of this feedback function, the output in line 26 is a function of the square root of the input in line 55. This square root extracting device is described more completely in application Ser. No. 729,511 filed on Oct. 4, 1976 and assigned to the assignee of the present invention.

Temperature sensors T1 and T2 are connected to a controller 70 which provides an electrical output signal proportional to the difference between the signals received from thermostats T1 and T2. The controller 70 may be an R7500C manufactured by Honeywell Inc. to perform this function. The electrical signal is converted to a pneumatic signal by circuit 71 which may be an RP7505 relay manufactured by Honeywell Inc. The output from relay 71 is a pneumatic signal proportional to the difference between the signals received from thermostats T1 and T2. This output is connected by line 28 to variable gain attentuator 50 to change the gain thereof.

Line 26 is connected to a first housing 72 to supply chamber 73 with the signal representing the volume of air moving through hot deck 19. Passage 74 establishes a linear pressure gradient ranging from the pressure in chamber 73 as supplied by line 26 to atmosphere to which the other side of channel 74 is connected. A tube 75 has orifice 76 therein to pick off a pressure along this gradient dependent upon the position of the orifice along the channel 74. The position of the orifice is controlled by the position of diaphragm 77 within housing 78. The diaphragm separates housing 78 into control chamber 79 and operating chamber 80. Attached to diaphragm 77 is operating cup 81 to which tube 75 is attached. Spring 82 biases cup 81 and diaphragm 77 arrangement in a direction opposite to the force supplied to diaphragm 77 by the pressure within chamber 79. Chamber 79 is supplied with pressure from output line 28. Therefore, the interior of tube 75 is connected to output 52 such that the output pressure in 52 represents the product of the volume of air moving through hot deck 19 and the differential temperature across heating coil 22, i.e., the amount of heating done in hot deck 19.

The controller for supplying a signal relating to the amount of cooling done in cold deck 20 is shown in FIG. 3. The circuit in FIG. 3 is an exact duplicate of the circuit shown in FIG. 2 except for the particular sensors connected to the controllers, and, therefore, there is no need to separately discuss this circuit here except to state that circuit 33 including square root extractor 91 supplies an output at 34 indicative of the volume of air moving through cold deck 20. Circuit 35 supplies an output at 36 indicative of the temperature differential across cooling coil 30 in the cold deck. Variable gain amplifier 90 operates on these two outputs, 34 and 36, to supply an output at 92 which is indicative of the amount of cooling done in cold deck 20. The prime numbers in FIG. 3 serve to indicate that the structures shown in FIG. 3 to produce the output at 92 are identical to the structure shown in FIG. 2 to produce the output at 52.

The output at 52 of the circuit of FIG. 2 may be given by the following expression:

$$\text{heating amount} = (T1 - T2)V_H$$

where T1 is the temperature sensed by thermostat T1, T2 is the temperature sensed by thermostat T2, and $V_H$ is the volume of air moving through hot deck 19. The output 92 of the circuit shown in FIG. 3 can be expressed by the following equation:

$$\text{Cooling amount} = (T3 - T4)V_C$$

where T3 is the temperature sensed by thermostat T3, T4 is the temperature sensed by thermostat T4, and $V_C$ is the volume of air moving through cold deck 20.

Since T1 = T3 = T and multiplying both equations by a cost factor relating to the respective heating or cooling, the following equations can be obtained:

$$\text{Heating cost} = (T - T2)V_H F_H$$

and $$\text{Cooling cost} = (T - T_4)V_C F_C.$$

where $F_H$ is the cost factor for heating and $F_C$ is the cost factor for cooling.

To minimize the total costs of heating and cooling in the air conditioning system, the air conditioning system is controlled so that the heating cost and the cooling cost are equal. The circuit of FIG. 4 results in this operation.

Output 92 from the circuit of FIG. 3 is supplied to the input of variable gain attenuator 100 and output 52 from the circuit of FIG. 2 is supplied to the input of two higher of two pressures lockout relays 101 and 102. To apply the cost factor with respect to the heating and cooling costs to the control system, main source of pressure 103 is connected through pressure regulating device 104, which may be a Honeywell SP970 regulator, with manual adjustment 105, to chamber 106 of housing 107 of variable gain attenuator 100. Adjustment of manual control 105 adjusts the pressure supplied to chamber 106 to vary the gain of variable gain attenuator 100. The housing 107 is divided by diaphragm 108 into control chamber 106 and operating chamber 109. Attached to diaphragm 108 within operating chamber 109 is operating cup 110 to which is attached tube 111 biased against the pressure in chamber 106 by spring 112. Tube 111 extends into housing 113 in which channel 114 is located. Channel 114 establishes a pressure gradient ranging from the pressure supplied by line 92 to atmosphere to which the other end of the channel 114 is connected. Orifice 115 of tube 111 picks off a pressure along the pressure gradient dependent upon its position along channel 114 as determined by the pressure issuing from regulator 104 and this pressure is communicated by tube 111 to output line 16.

Both the heating amount circuit of FIG. 2 and the cooling amount circuit of FIG. 3 can have connected to their respective outputs a variable gain amplifier such as 100 in FIG. 4. In such a construction, the heating cost factor and the cooling cost factor would be separately adjusted in each variable gain amplifier to reflect the weight given to the heating cost and the weight given to the cooling cost. However, in the preferred embodiment, this weighting can be accomplished by a single variable gain amplifier 100 as shown in FIG. 4. The manual adjustment 105 is adjusted to reflect the ratio of the relative heating and cooling costs or the weight of the relative heating and cooling costs.

Whereas output 52 from the heating amount circuit of FIG. 2 is connected to a first input of each of the higher of two pressures lockout relays 101 and 102, output 116 is connected to the other input of each of the relays 101 and 102. These relays may be relays RP470B which function to connect input 116 to output 117 if input 52 is less than input 116 or supply no input to output 117, in the case of relay 101. With respect to relay 102, input 52 is connected to output 120 if input 116 is less than input 52; otherwise, output 120 receives no input. The output 117 of relay 101 is connected through restriction 118 to a switching relay 119. The switching relay may be an RP670 relay manufactured by Honeywell Inc. Output 120 of the relay 102 is connected through restriction 121 to delay tank 122. Delay tank 122 has two outputs. The first output 123 is connected through restriction 124 to the switching relay 119. The second output 40 is connected to the control point adjustment portion 42 of controller 41 as shown in FIG. 1.

In operation, relays 101 and 102 compare output 52 to output 116. If output 116 is greater than output 52, indicating that the cooling costs of cooling the air within deck 20 is greater than the heating cost of heating the air in deck 19, relay 101 is operated to allow output 116 to be connected to output 117 which operates circuit 119 to connect tank 122 through line 123 and restriction 124 to atmosphere through line 125 which reduces the pressure in tank 122 causing controller 41 to go to a lower set point and begin opening damper 12 and closing damper 15 to lower the amount of cooling which must be done by the cooling coil 30. The decreased temperature within supply duct 16 will increase heating costs but will result in decreased cooling costs. This action will continue until the heating and cooling costs are equalized. If, on the other hand, the pressure within the output 52 is greater than the pressure in output 116, indicating that the heating cost is greater than the cooling cost, the pressure in line 52 shuts off the relay 101 so that tank 122 is not connected to atmosphere through line 125 and opens relay 102 to supply the pressure of output 52 through relay 102 to line 120, through restriction 121 and to tank 122 increasing the pressure within the tank and thus the output pressure in line 40 to controller 41 to raise its set point and begin closing damper 12 and opening damper 15 to increase the temperature within the supply duct 16.

In this manner, the cost of heating the air in hot deck 19 and the cost of cooling the air in cold deck 19 are equalized to minimize the total cost of heating and cooling in the air conditioning system.

Figure 5:
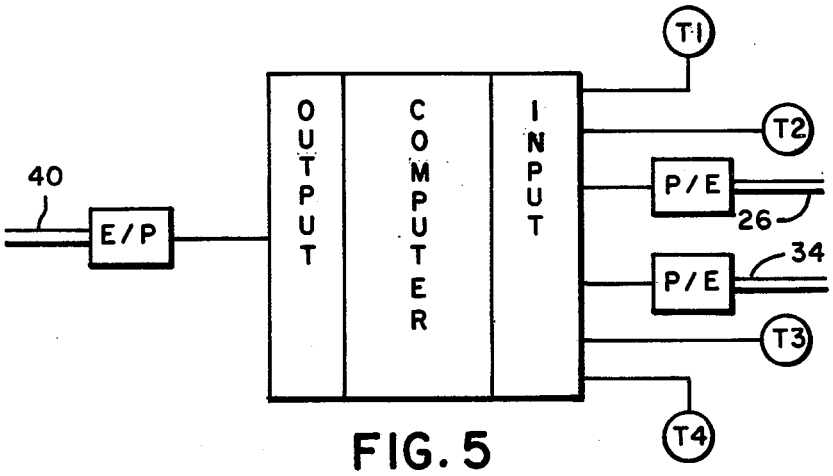
FIG. 5 is a computer system for carrying out the present invention.
Figure 6:
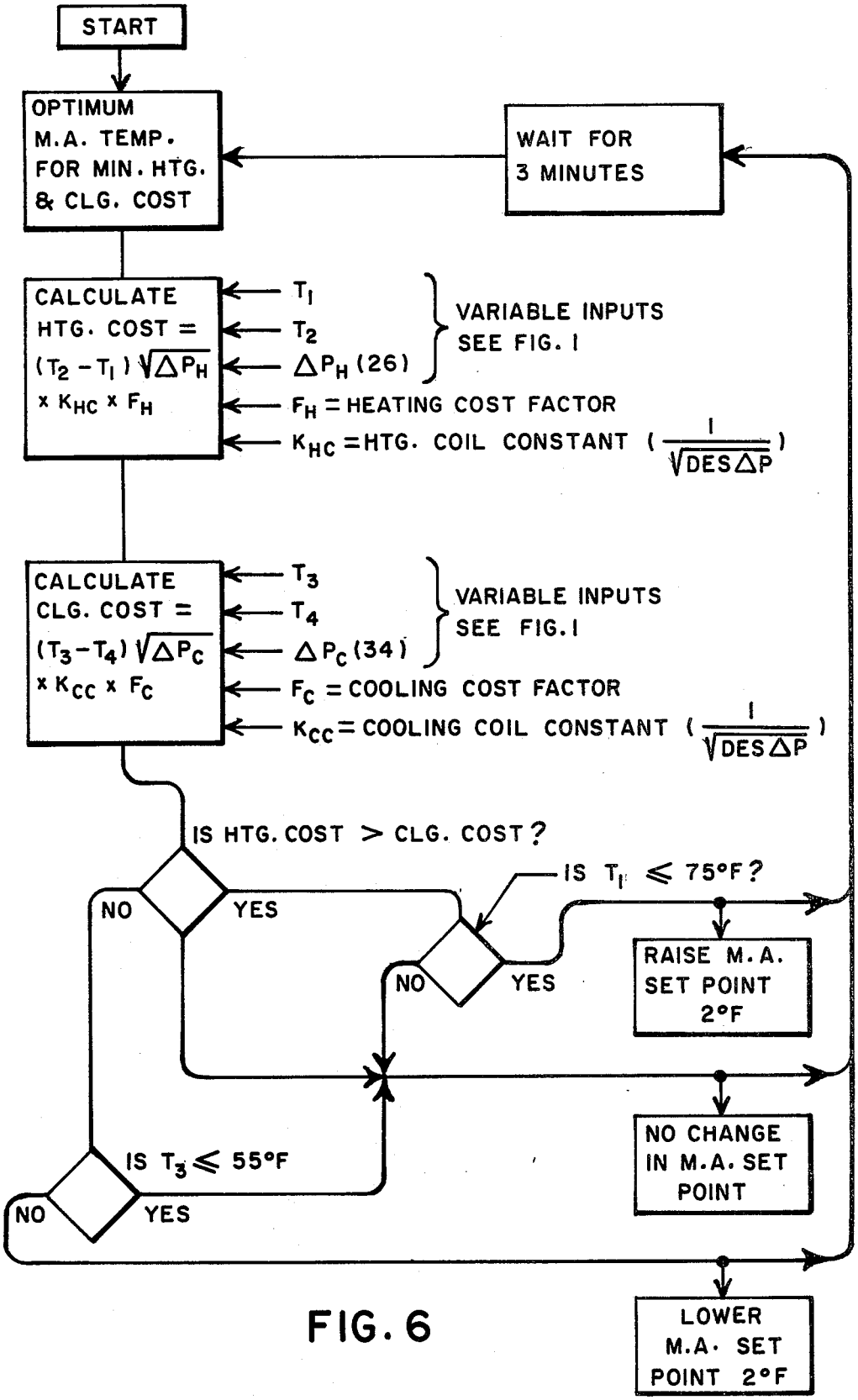
FIG. 6 is a flow chart of a program that can be used in the computer of FIG. 5.

FIGS. 5 and 6 show a computerized approach to achieve the same result, i.e., equalizing the heating and cooling costs in a temperature control system. In FIG. 5, a computer is provided which may be the computer of the Delta 1000 manufactured by Honeywell, Inc. This computer has in input portion which is connected to thermostats T1, T2, T3 and T4 and to pressure to electric controls having inputs at 26 and 34 as shown in FIG. 1. The pressure to electric controls provide a proportional electric output dependent upon the pressure input. The computer then operates on these inputs according to the flow chart of FIG. 6 and provides an output signal through its output portion to an electric to pneumatic controller to output line 40 as shown in FIG. 1.

At the start of the program shown in FIG. 6, the optimum mixed air temperature for minimum heating and cooling costs box is shown merely for explanation of the function of the program and does not otherwise perform a function in the program except as a feedback path. The program first calculates the heating cost as shown in FIG. 6. It should be pointed out that the heating cost factor and the cooling cost factor may be separate inputs or a single input may be provided to indicate the relative heating and cooling cost factors. The term "DESAP" is the design differential pressure which exists across the heating coil at full air flow therethrough. Similarly, the cooling cost is calculated according to the formula shown. The term "DESAP" is the design differential pressure which exists across the cooling coil at full air flow therethrough.

The program then determines whether the heating cost is greater than, equal to, or less than the cooling cost. If the heating cost is equal to the cooling cost, the program waits for three minutes and then repeats the calculations and decisions. If the heating cost is greater than the cooling cost, the program next determines whether the temperature sensed by sensor T1 is less than or equal to 75° F. This step, in essence, establishes an upper limit for the mixed air temperature existing mixing chamber 13. If this temperature is greater than 75° F, the program does not attempt to change the mixed air temperature but waits for three minutes and then repeats these calculations. If this temperature is less than or equal to 75° F, the program raises the set point temperature of the mixed air by 2° F by providing an appropriate output from the computer to the electric to pneumatic control and then out on pneumatic line 40 to controller 41. The program then waits for three minutes and repeats these calculations.

If the heating cost is less than the cooling cost, the program determines whether the temperature sensed by sensor T3 is less than or equal to 55° F. This step establishes a lower limit for the mixed air temperature. If the temperature is below 55° , no action is taken and the program waits for three minutes and then repeats the calculations. If the temperature sensed by sensor T3 is above 55° F, the mixed air set point temperature is lowered 2° F by appropriately adjusting the pressure in pneumatic line 40 to controller 41. The program then waits for three minutes and repeats these calculations.

The embodiments of the invention in which an exclusive property or right is claimed are defined as follows:

1. In an air conditioning system having a supply duct and return air and outdoor air dampers to mix the air in said supply duct, a hot deck supplied with air from said supply duct and heating means to heat the air in said hot deck, and a cold deck supplied with air from said supply duct and cooling means to cool the air in said cold deck, a control system for minimizing the cost of the energy to heat the air in the hot deck and cool the air in the cold deck, said control system comprising:

first means for supplying a first signal dependent upon the amount of heating done in the hot deck;

second means for supplying a second signal dependent upon the amount of cooling done in the cold deck;

weighting means for adjusting the weighting to be given to said first and second signals;

comparison means connected to said first means, said second means and said weighting means for producing an output dependent upon the difference between the amount of cooling and the amount of heating and adjusted for the difference between the relative weighting of the first and second signals;

control means connected to the output of said comparison means and adapted to control the return air and outdoor air damper to control the temperature of the air in the supply duct according to said first and second signal as weighted by said weighting means.

2. The control system of claim 1 wherein said first means comprises volume sensing means for measuring the volume of air moving through the hot deck, differential temperature sensing means for measuring the differential temperature between the temperature of air supplied by the hot deck and the temperature of air supplied by the supply duct, and heating combining means connected to said volume sensing means and to said differential temperature sensing means for producing said first signal.

3. The control system of claim 2 wherein said second means comprises volume sensing means for measuring the volume of air moving through the cold deck, differential temperature sensing means for measuring the differential temperature between the temperature of the air supplied by the cold deck and the temperature of the air supplied by the supply duct, and cooling combining means connected to said volume sensing means of said second means and to said differential temperature sensing means of said second means for producing said second signal.

4. The control system of claim 3 wherein said heating combining means comprises a variable gain attenuator having an input connected to the volume sensing means of the first means, a gain changing input connected to the differential temperature sensing means of the first means and having an output, and said cooling combining means comprises a variable gain attenuator having a first input connected to the volume sensing means of said second means, a variable gain changing input connected to the differential temperature sensing means of the second means and having an output.

5. The control system of claim 4 wherein the comparison means comprises a variable gain attenuator having a variable gain changing input connected to the output of said variable gain attenuator of said second means, and having a further input connected to said weighting means and an output, a first high pressure lockout switch having a first input connected to the output of the variable gain attenuator of the first means, a second input connected to the output of the variable gain attenuator of said comparison means, and an output connected to said control means, and a second high pressure lockout switch having a first input connected to the output of the variable gain attenuator of said first means, a second input connected to the output of the variable gain attenuator of said comparison means and an output connected to said control means.

6. The control system of claim 5 wherein said weighting means comprises a manually adjustable pressure selector means connected to the further input of the variable gain attenuator of said comparison means.

7. The control system of claim 6 wherein said control means comprises a delay tank having an input connected to the output of said second high pressure lockout switch, a first output and a second output, a pressure responsive switch having an input connected to the output of said first high pressure lockout switch, a second input connected to the first output of said tank and a second output connected to atmosphere, and a controller connected to the second output of said tank for controlling the temperature of the air in said supply duct.

8. In an air conditioning system having a supply duct and return air and outdoor air dampers to mix the air in said supply duct, a hot deck supplied with air from said supply duct and heating means to heat the air in said hot deck, and a cold deck supplied with air from said supply duct and cooling means to cool the air in said cold deck, a control system for minimizing the cost of the energy needed to heat the air in the hot deck and cool the air in the cold deck, said control system comprising:

first means for measuring the amount of heating done in the hot deck and for producing an output indicative of a cost of heating the air in the hot deck;

second means for measuring the amount of cooling done in the cold deck and for producing an output indicative of a cost of cooling the air in the cold deck;

comparison means connected to said first and second means to receive said outputs for producing a signal indicating a difference between the cost of heating and the cost of cooling; and, control means connected to said comparson means and responsive to said signal and adapted to control the return air and outdoor air dampers to control the condition of the air in the supply duct for equalizing the cost of heating and the cost of cooling.

9. The control system of claim 8 wherein said first means comprises volume sensing means for measuring the volume of air moving through the hot deck, differential temperature sensing means for measuring the differential temperature between the temperature of air supplied by the hot deck and the temperature of air supplied by the supply duct, and heating combining means connected to said volume sensing means and to said differential temperature sensing means for producing a signal indicative of the amount of heating done in the hot deck.

10. The control system of claim 9 wherein said second means comprises volume sensing means for measuring the volume of air moving through the cold deck, differential temperature sensing means for measuring the differential temperature between the temperature of the air supplied by the cold deck and the temperature of the air supplied by the supply duct, and cooling combining means connected to said volume sensing means of said second means and to said differential temperature sensing means of said second means for producing a signal indicative of the amount of cooling done in the cold deck.

11. The control system of claim 10 wherein said heating combining means comprises a variable gain attenuator having an input connected to the volume sensing means of the first means and a gain changing input connected to the differential temperature sensing means of the first means and having an output, and said cooling combining means comprises a first variable gain attenuator having a first input connected to the volume sensing means of said second means and a variable gain changing input connected to the differential temperature sensing means of the second means and having an output.

12. The control system of claim 11 wherein said second means further comprises a second variable gain attenuator having a variable gain changing input connected to the output of said variable gain attenuator of said second means, having an output connected to said comparison means, and having a further input and a manually adjustable pressure selector means connected to the further input of the second variable gain attenuator of said second means for adjusting the relative cost of cooling and cost of heating.

13. The control system of claim 12 wherein said comparison means comprises a first high pressure lockout switch having a first input connected to the output of the variable gain attenuator of the first means, a second input connected to the output of the second variable gain attenuator of said second means, and an output connected to said control means, and a second high pressure lockout switch having a first input connected to the output of the variable gain attenuator of said first means, a second input connected to the output of the second variable gain attenuator of said second means and an output connected to said control means.

14. The control system of claim 13 wherein said control means comprises a delay tank having an input connected to the output of said second high pressure lockout switch, a first input and a second output, a pressure responsive switch having an input connected to the output of said first high pressure lockout switch, a second input connected to the first output of said tank and an output connected to atmosphere, and a controller connected to the second output of said tank for controlling the temperature of the air in said supply duct.

15. In an air conditioning system having a supply duct and return air and outdoor air dampers to mix the air in said supply duct, a hot deck supplied with air from said supply duct and heating means to heat the air in said hot deck, and a cold deck supplied with air from said supply duct and cooling means to cool the air in said cold duct, a control system for minimizing the cost of the energy needed to heat the air in the hot deck and cooling the air in the cold deck, said control system comprising:

first means for measuring the amount of heating done in the hot deck;

second means for measuring the amount of cooling done in the cold deck;

cost means for generating a signal representing the costs of heating and cooling;

comparison means connected to said first means, said second means and said cost means for producing an output dependent upon the difference between the amount of heating and the amount of cooling and adjusted for the difference between the costs of heating and the cost of cooling;

control means connected to the output of said comparison means and adapted to control the return air and outdoor air dampers to control the condition of the air in the supply duct for equalizing the cost of heating and the cost of cooling.

16. The control system of claim 15 wherein said first means comprises volume sensing means for measuring the volume of air moving through the hot deck, differential temperature sensing means for measuring the differential temperature between the temperature of air supplied by the hot deck and the temperature of air supplied by the supply duct, and heating combining means connected to said volume sensing means and to said differential temperature sensing means for producing a signal indicative of the amount of heating done in the hot deck.

17. The control system of claim 16 wherein said second means comprises volume sensing means for measuring the volume of air moving through the cold deck, differential temperature sensing means for measuring the differential temperature between the temperature of the air supplied by the cold deck and the temperature of the air supplied by the supply duct, and cooling combining means connected to said volume sensing means of said second means and to said differential temperature sensing means of said second means for producing a signal indicative of the amount of cooling done in the cold deck.

18. The control system of claim 17 wherein said heating combining means comprises a variable gain attenuator having an input connected to the volume sensing means of the first means and a gain changing input connected to the differential temperature sensing means of the first means and having an output, and said cooling combining means comprises a variable gain attenuator having a first input connected to the volume sensing means of said second means and a variable gain changing input connected to the differential temperature sensing means of the second means and having an output.

19. The control system of claim 18 wherein the comparison means comprises a variable gain attenuator having a variable gain changing input connected to the output of said variable gain attenuator of said second means, and having a further input connected to said cost means and an output, a first high pressure lockout switch having a first input connected to the output of the variable gain attenuator of the first means, a second input connected to the output of the variable gain attenuator of said comparison means, and an output connected to said control means, and a second high pressure lockout switch having a first input connected to the output of the variable gain attenuator of said first means, a second input connected to the output of the variable gain attenuator of said comparison means and an output connected to said control means.

20. The control system of claim 19 wherein said cost means comprises a manually adjustable pressure selector means connected to the further input of the variable gain attenuator of said comprison means.

21. The control system of claim 20 wherein said control means comprises a delay tank having an input connected to the output of said second high pressure lockout switch, a first output and a second output, a pressure responsive switch having an input connected to the output of said first high pressure lockout switch, a second input connected to the first output of said tank and an output connected to atmosphere, and a controller connected to the second output of said tank for controlling the temperature of the air in said supply duct.

* * * * *